US007155025B1

(12) United States Patent
Weffer

(10) Patent No.: US 7,155,025 B1
(45) Date of Patent: Dec. 26, 2006

(54) SURROUND SOUND HEADPHONE SYSTEM

(76) Inventor: Sergio W. Weffer, 145 S. 300 East #25, Salt Lake City, UT (US) 84110-2108

( * ) Notice: Subject to any disclaimer, the term of this patent is extended or adjusted under 35 U.S.C. 154(b) by 0 days.

(21) Appl. No.: 10/232,040

(22) Filed: Aug. 30, 2002

(51) Int. Cl.
*H04R 25/00* (2006.01)

(52) U.S. Cl. ..... 381/370; 381/371; 381/374; 381/384

(58) Field of Classification Search ..... 381/309, 381/310, 370, 371, 375, 376, 182, 186, 374, 381/384; 379/430; 345/7, 8; 181/141; 362/105, 362/190, 198, 206
See application file for complete search history.

(56) References Cited

U.S. PATENT DOCUMENTS

| | | | | |
|---|---|---|---|---|
| 3,796,840 | A | 3/1974 | Ohta | |
| 3,943,304 | A | 3/1976 | Piribauer | |
| 3,984,885 | A | 10/1976 | Yoshimura et al. | |
| 4,173,715 | A | 11/1979 | Gosman | |
| 5,333,206 | A | 7/1994 | Koss | |
| D353,818 | S | 12/1994 | Nakamura | |
| 5,371,799 | A | 12/1994 | Lowe et al. | |
| D376,362 | S | 12/1996 | Bozorgi-Ram | |
| 5,661,812 | A | 8/1997 | Scofield et al. | |
| 5,680,465 | A | 10/1997 | Boyden | |
| 5,815,126 | A * | 9/1998 | Fan et al. | 345/8 |
| 5,894,113 | A * | 4/1999 | Wingate | 181/141 |
| 5,951,141 | A * | 9/1999 | Bradley | 362/105 |
| 6,034,653 | A * | 3/2000 | Robertson et al. | 345/8 |
| 6,263,085 | B1 | 7/2001 | Weffer | |
| 6,637,910 | B1 * | 10/2003 | Mehler et al. | 362/190 |

* cited by examiner

*Primary Examiner*—Huyen Le

(57) ABSTRACT

A surround sound headphone system for enhancing a wearer's listening experience by providing a surround sound speaker configuration therein. The surround sound headphone system includes a headphone assembly including a pair of earpieces each having at least two speakers. The system also includes transmitting structure for transmitting sound signals from a sound signal source to the speakers of the earpieces in a manner transmitting a separate sound signal to each of said speakers in each of the earpieces. One embodiment includes a signal cord assembly for transferring a separate sound signal to each of the speakers, and includes novel signal plug and signal jack structures.

14 Claims, 11 Drawing Sheets

FIG. 6
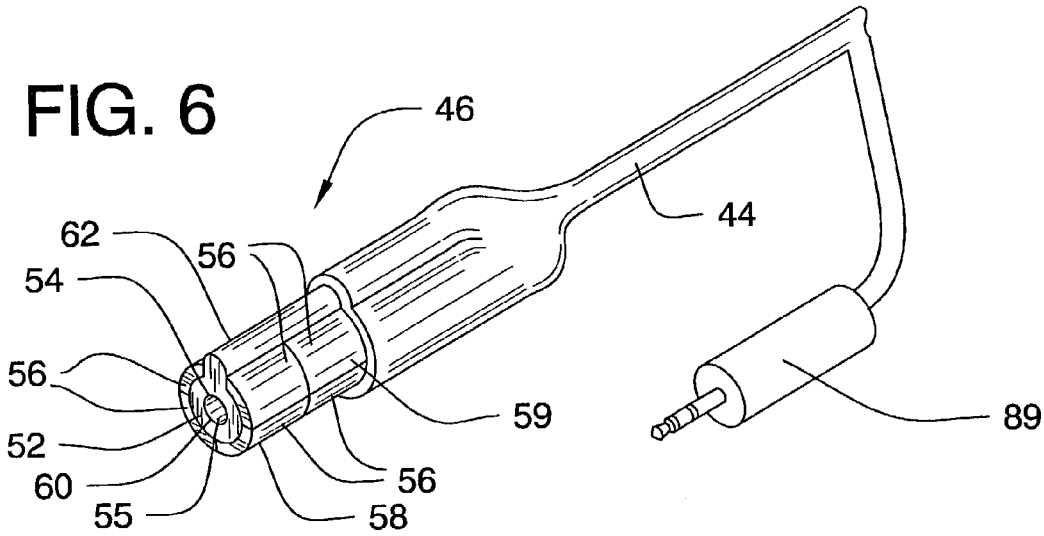
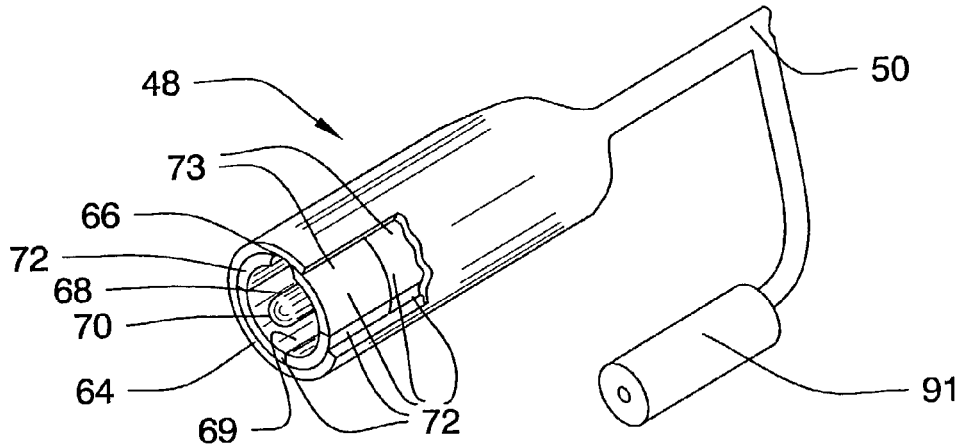
FIG. 7
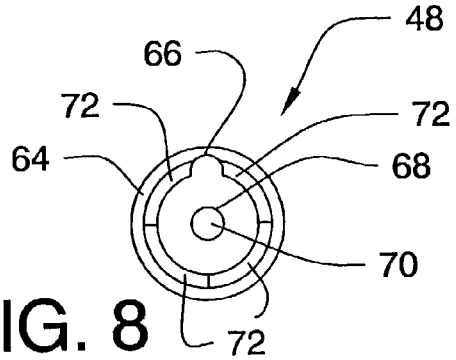
FIG. 8
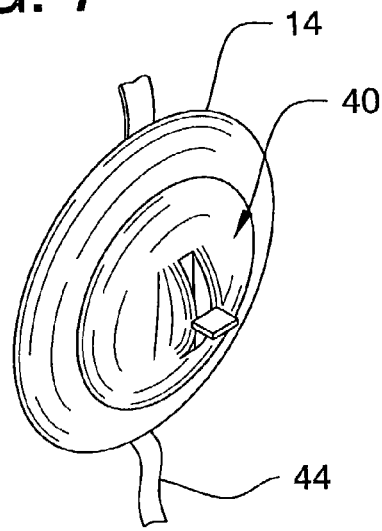
FIG. 5

SURROUND SOUND HEADPHONE SYSTEM

BACKGROUND OF THE INVENTION

1. Field of the Invention

The present invention relates to headphones and more particularly pertains to a new surround sound headphone system for enhancing a wearer's listening experience by providing a surround sound speaker configuration therein.

2. Description of the Prior Art

The use of headphones is known in the prior art. More specifically, headphones heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,796,840; U.S. Pat. No. 5,661,812; U.S. Pat. No. 5,371,799; U.S. Pat. No. 5,333,206; U.S. Pat. No. Des. 376,362; and U.S. Pat. No. Des. 353,818 which are incorporated herein by reference to the extent necessary for understanding the present invention.

While these devices fulfill their respective, particular objectives and requirements, the aforementioned patents do not disclose a new surround sound headphone system. The inventive device includes a headband for wear on a user's head and a pair of earpieces coupled to the headband. Each of the earpieces has an open inner face which defines a cavity in the respective earpiece. Each earpiece may also have a generally circular shaped fabric covered shield covering the open inner face of the respective earpiece. The inner face of each of the earpieces has a center extent extending into the cavity of the respective earpiece. The center extent has a plurality of side faces each having at least one speaker mounted thereto.

In these respects, the surround sound headphone system according to the present invention substantially departs from the conventional concepts and designs of the prior art, and in so doing provides an apparatus primarily developed for the purpose of enhancing a wearer's listening experience by providing a surround sound speaker configuration therein.

SUMMARY OF THE INVENTION

In view of the foregoing disadvantages inherent in the known types of headphones now present in the prior art, the present invention provides a new surround sound headphone system construction wherein the same can be utilized for enhancing a wearer's listening experience by providing a surround sound speaker configuration therein.

The general purpose of the present invention, which will be described subsequently in greater detail, is to provide a new surround sound headphone system apparatus and method which has many of the advantages of the headphones mentioned heretofore and many novel features that result in a new surround sound headphone system which is not anticipated, rendered obvious, suggested, or even implied by any of the prior art headphones, either alone or in any combination thereof.

To attain this, the present invention generally comprises a headband for wear on a user's head and a pair of earpieces coupled to the headband. Each of the earpieces has an open inner face which defines a cavity in the respective earpiece. The inner face of each of the earpieces has a center extent extending into the cavity of the respective earpiece. The center extent has a plurality of side faces each having at least one speaker mounted thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new surround sound headphone system apparatus and method which has many of the advantages of the headphones mentioned heretofore and many novel features that result in a new surround sound headphone system which is not anticipated, rendered obvious, suggested, or even implied by any of the prior art headphones, either alone or in any combination thereof.

It is another object of the present invention to provide a new surround sound headphone system which may be easily and efficiently manufactured and marketed.

It is a further object of the present invention to provide a new surround sound headphone system which is of a durable and reliable construction.

An even further object of the present invention is to provide a new surround sound headphone system which is susceptible of a low cost of manufacture with regard to both materials and labor, and which accordingly is then susceptible of low prices of sale to the consuming public, thereby making such surround sound headphone system economically available to the buying public.

Still yet another object of the present invention is to provide a new surround sound headphone system which provides in the apparatuses and methods of the prior art some of the advantages thereof, while simultaneously overcoming some of the disadvantages normally associated therewith.

Still another object of the present invention is to provide a new surround sound headphone system for enhancing a wearer's listening experience by providing a surround sound speaker configuration therein.

Yet another object of the present invention is to provide a new surround sound headphone system which includes a headband for wear on a user's head and a pair of earpieces coupled to the headband. Each of the earpieces has an open inner face which defines a cavity in the respective earpiece. The inner face of each of the earpieces has a center extent extending into the cavity of the respective earpiece. The center extent has a plurality of side faces each having at least one speaker mounted thereto.

Still yet another object of the present invention is to provide a new surround sound headphone system that makes a wearer experience sound that appears to be coming from in front of, behind, above, and below the wearer to thereby further enhance the wearer's listening enjoyment and realism.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic side view of an earpiece showing an optional volume controller for the system of the present invention.

FIG. 6 is a schematic perspective view of one embodiment of a jack of the system of the present invention for use with the surround sound headphones.

FIG. 7 is a schematic perspective view of an adapter cord with one embodiment of a plug of the system of the present invention for use with the surround sound headphones, and having a portion of an outer insulating material being removed to reveal the conductive contacts of the plug.

FIG. 8 is a schematic end view of the plug of FIG. 7.

DESCRIPTION OF THE PREFERRED EMBODIMENT

Figure 1:
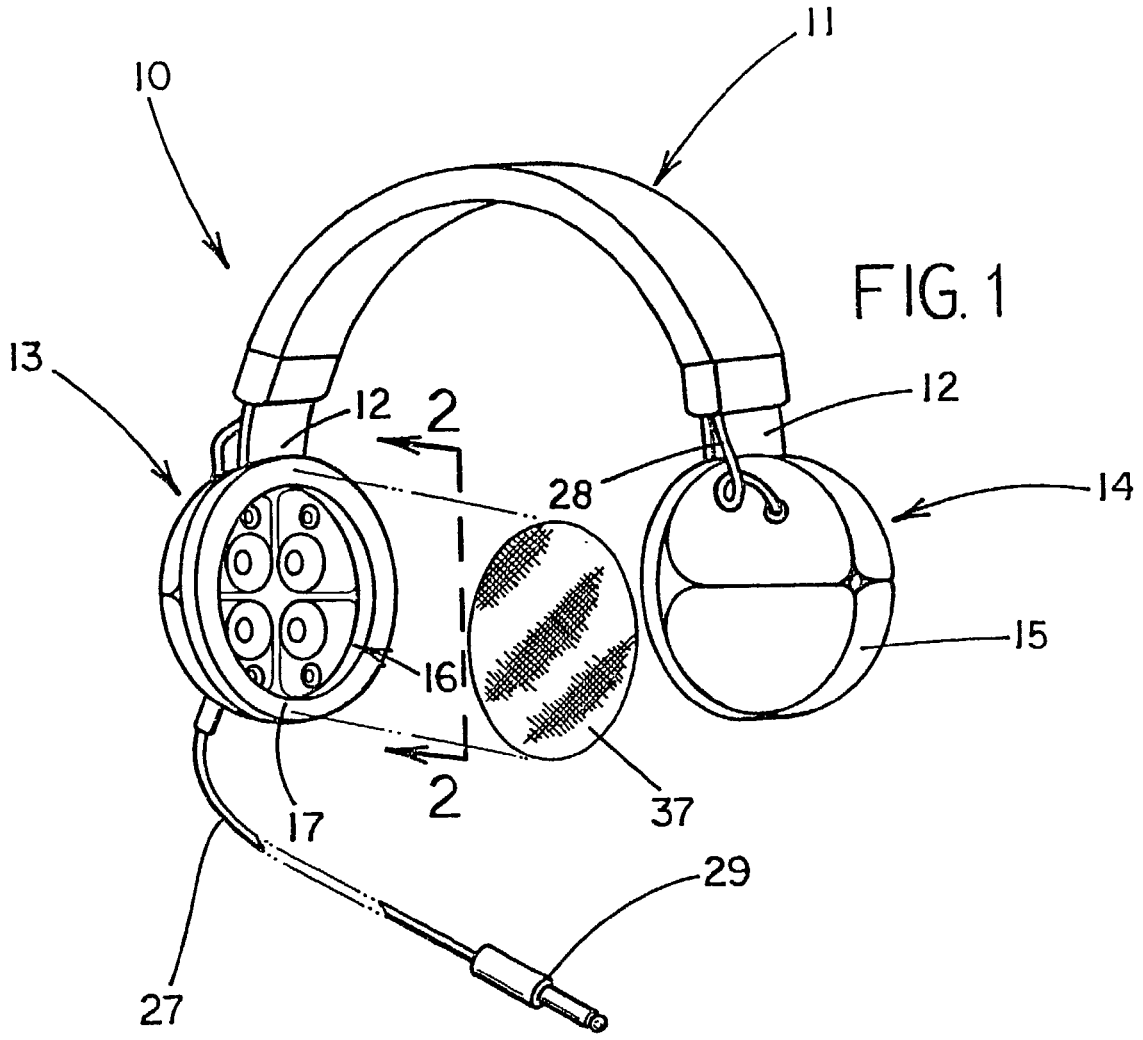
FIG. 1 is a schematic perspective view of a new surround sound headphone system according to the present invention.
Figure 2:
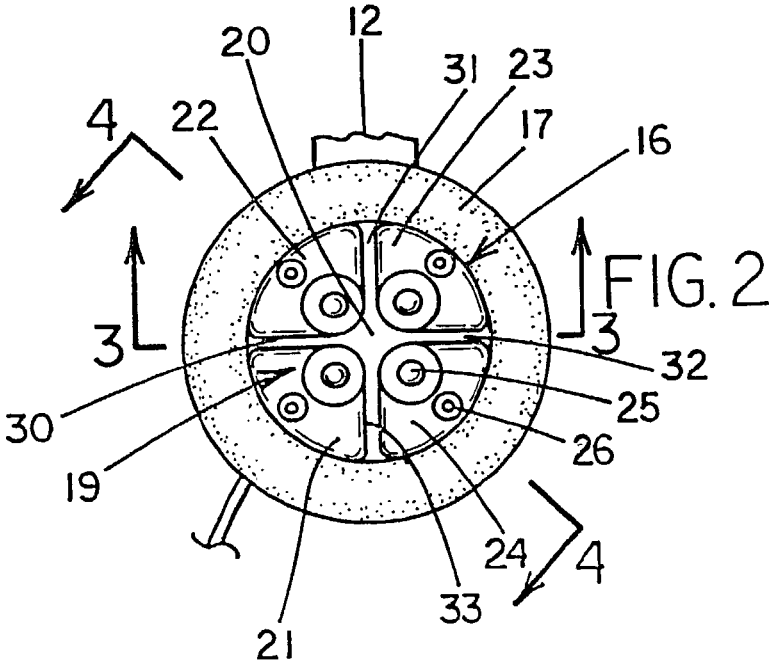
FIG. 2 is a schematic side view of an inner face of an earpiece of the present invention taken from the vantage of line 2—2 of FIG. 1.

With reference now to the drawings, and in particular to FIGS. 1 through 16 thereof, a new surround sound headphone system embodying the principles and concepts of the present invention and generally designated by the reference numeral 10 will be described.

As best illustrated in FIGS. 1 through 4, the surround sound headphone system 10 generally comprises a headband for wear on a user's head and a pair of earpieces coupled to the headband. Each of the earpieces has an open inner face which defines a cavity in the respective earpiece. Each earpiece may also have a generally circular shaped fabric covered shield covering the open inner face of the respective earpiece. The inner face of each of the earpieces has a center extent extending into the cavity of the respective earpiece. The center extent has a plurality of side faces each having at least one speaker mounted thereto.

In use, the surround sound headphones are designed for electrically connecting to an audio system for generating sounds therefrom to create a surround sound audio experience. Specifically, the surround sound headphones 10 include an arcuate headband 11 which is designed for wear on a user's head and has a pair of opposite ends. Each end of the headband may have a telescopically extendable portion 12 to permit selective adjustment of the overall length of the headband.

The headphones also include a pair of earpieces 13, 14. One of the earpieces housings is coupled to one of the ends of the headband and the other of the earpieces is coupled to the other of the ends of the headband. Each of the earpieces may have a generally dome-shaped outer face 15 and an open inner face 16. The inner faces of the earpieces face each other. Each earpiece may also have a generally circular shaped fabric covered shield 37 covering the open inner face of the respective earpiece. The inner face of one of the earpieces is designed for placement over one ear of the user and the inner face of the other of the earpieces is designed for placement over another ear of the user.

In one embodiment, each of the earpieces may have a resiliently deformable annular earpad 17 around a generally circular outer periphery 18 of the inner face of the respective earpiece. In one such embodiment, the annular earpads each may comprise a resiliently deformable foamed material.

Figure 3:
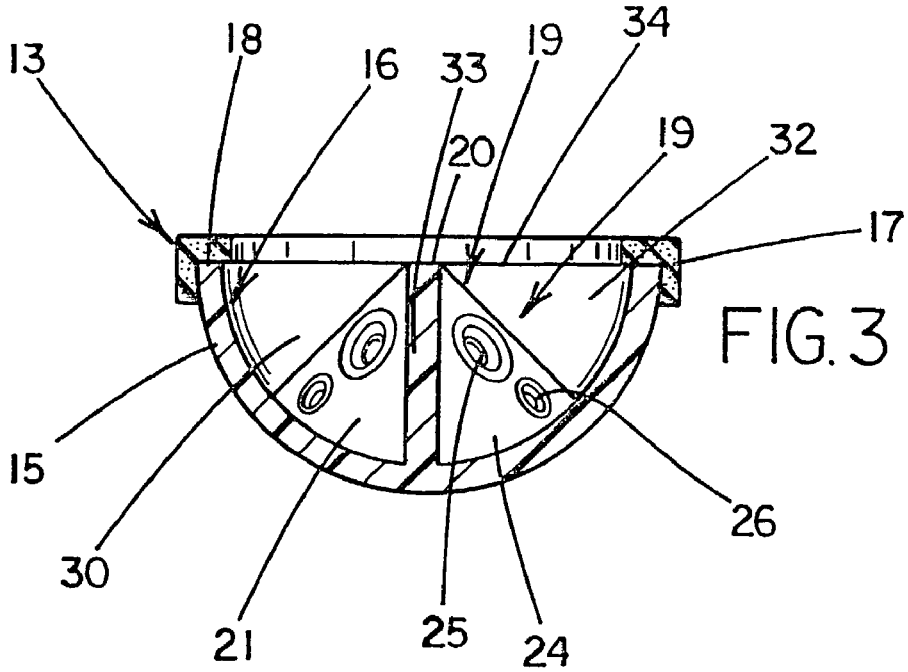
FIG. 3 is a schematic cross sectional view of an earpiece taken from line 3—3 of FIG. 2.
Figure 4:
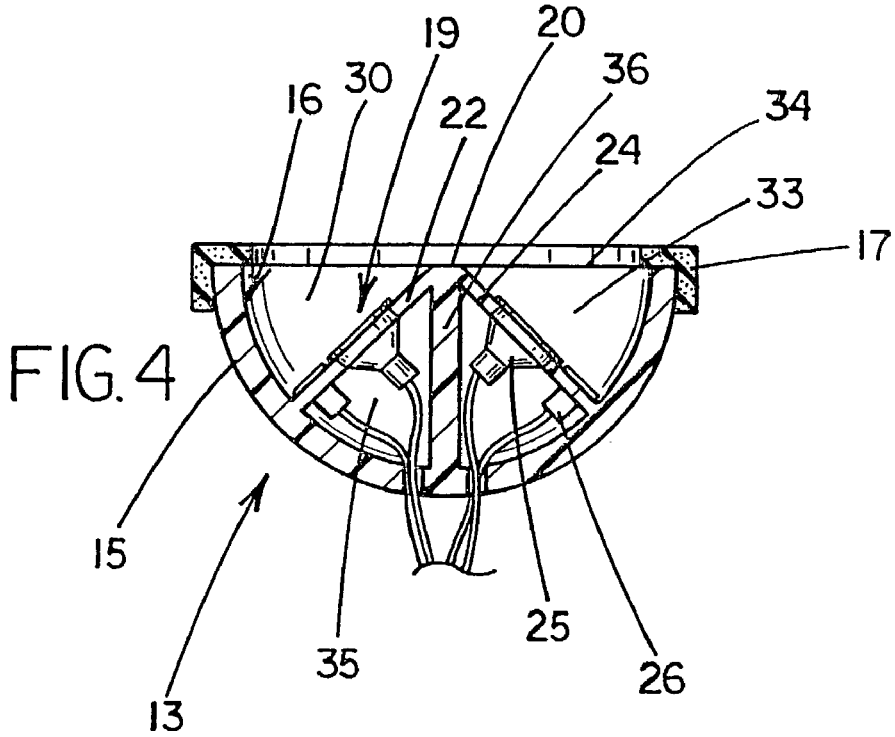
FIG. 4 is a schematic cross sectional view of an earpiece taken from line 4—4 of FIG. 2.
Figure 9:
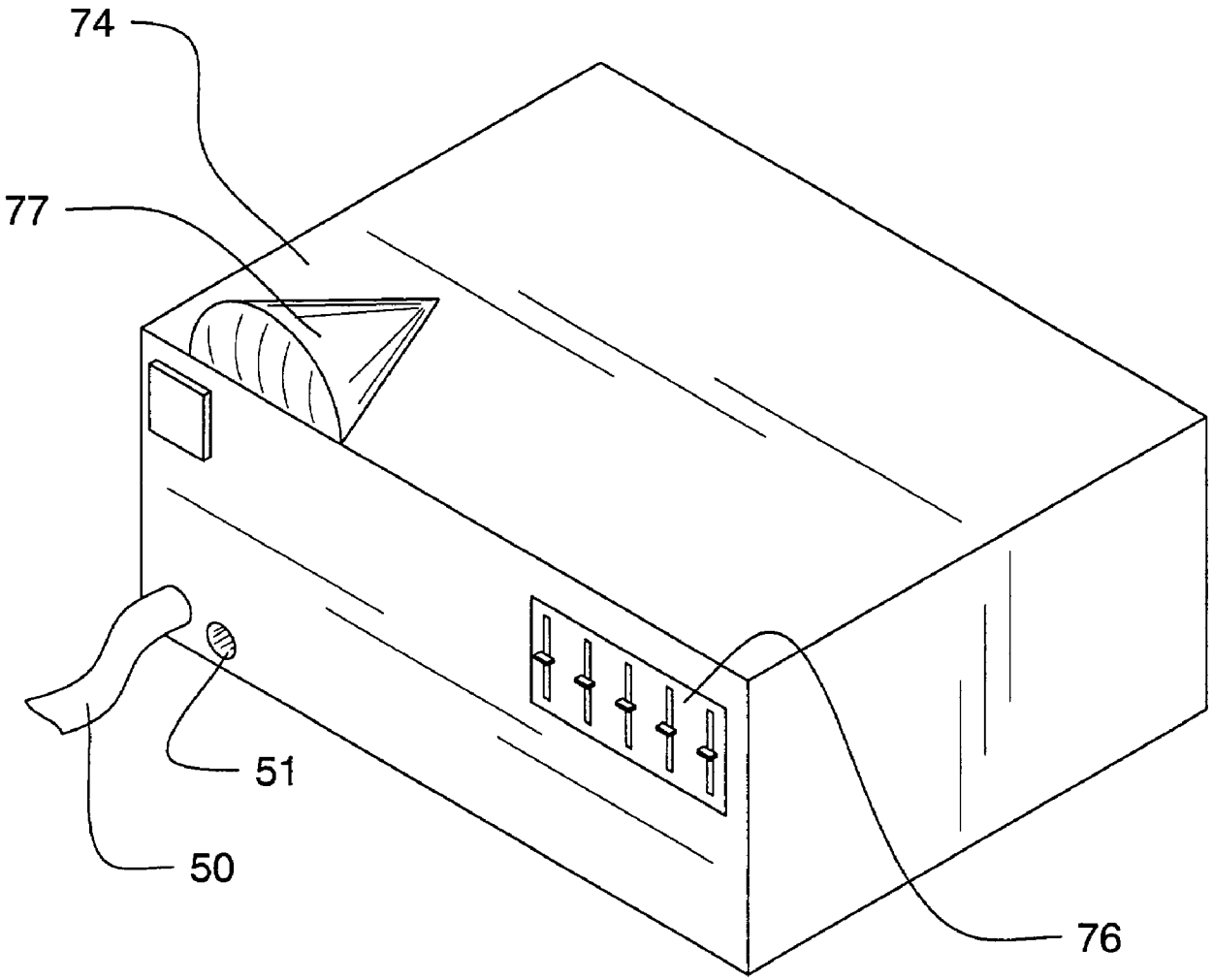
FIG. 9 is a schematic perspective view of an optional controller unit of the present invention.
Figure 10:
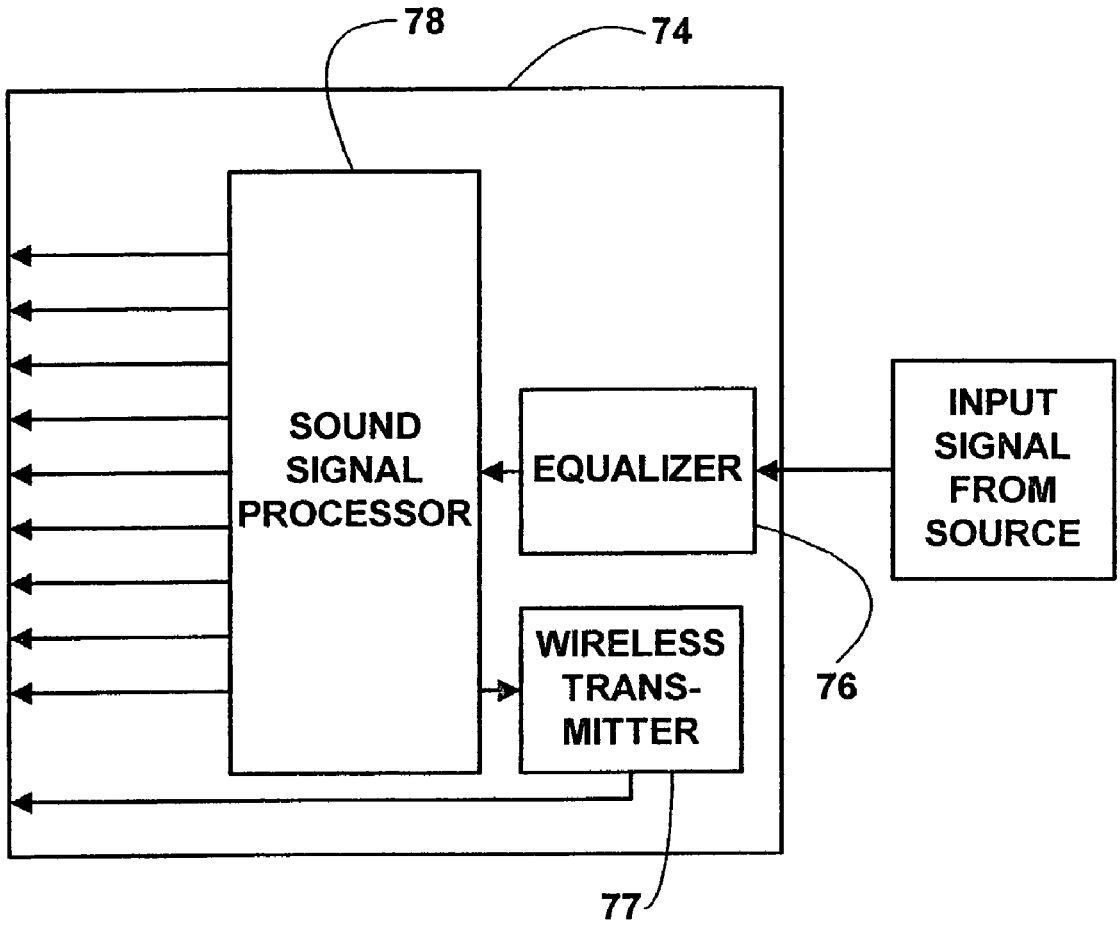
FIG. 10 is a schematic diagram of some of the elements of the controller unit.

As best illustrated in FIGS. 3 and 4, the inner faces of the earpieces each define a generally hemispherical concave cavity in the respective earpiece. The inner face of each of the earpieces has a generally pyramidal center extent 19 extending into the cavity of the respective earpiece. The center extent of each earpiece has a vertex 20 extending towards a plane in which the outer periphery of the inner face of the respective earpiece lies. In one embodiment, the vertex may actually lie in a common plane with the outer periphery of the inner face.

The center extent of each earpiece also has four generally triangular side faces 21, 22, 23, 24. Each of the side faces of the center extent of each earpiece has a pair of speakers 25, 26 mounted thereto. In one embodiment, each pair of speakers may include a woofer-type speaker 25 and a tweeter-type speaker 26.

The speakers of each earpiece are electrically connectable to an audio system so that the speakers may generate audible sounds corresponding to signals received by the speakers from the audio system. In one embodiment, the speakers of each earpiece may have circuitry and wiring arranged to interact with a surround sound component of the audio system such that the speakers of each face emit sounds corresponding to in a manner to simulate surround sound as generated by the surround sound system. For example, the speakers of a first of the side faces of each earpiece are configured to emit sounds simulating sounds coming from in front of the wearer, the speakers of a second of the side faces of each earpiece are configured to emit sounds simulating sounds coming from behind the wearer, the speakers of a third of the side faces of each earpiece are configured to emit sounds simulating sounds coming from above of the wearer, and the speakers of a fourth of the side faces of each earpiece are configured to emit sounds simulating sounds coming from below the wearer.

In one embodiment, an elongate flexible cable 27 is outwardly extended from one of the earpieces. The speakers of both earpieces are electrically connected to the cable with the speakers of the other earpiece is connected via a second cable 28 extending between the earpieces and through the headband. The cable 27 has a free end with a plug 29 for inserting into a socket of the audio system to electrically connect the cable and speakers to the audio system.

In one embodiment, the center extents each have four outwardly radiating baffles 30, 31, 32, 33 extending to the inner surface of the respective earpiece. Each of the baffles of each center extent is outwardly extended from a corresponding side edge of the center extent which is positioned between a pair of adjacent associated faces of the respective center extent. As illustrated in the Figures, the baffles divide the cavity of the respective earpiece into four compartments with one side face of the respective center extent located in each of the compartments.

In one such embodiment, each of the baffles may have a substantially straight upper edge 34 extending between the vertex of the respective center extent and the outer perimeter of the inner face of the respective earpiece such that the upper edges of the baffles lie in a common plane with the outer perimeter of the inner face of the respective earpiece. This way, the baffles sonically isolate each of the compartments from one another when the earpieces are worn over the ears of the user to thereby impart a surround sound quality to the sounds generated by the speakers.

In an optional embodiment, as shown in FIGS. 3 and 4, each of the center extents has a hollow interior 35 and has a center post 36 extending from a center of the inner face of the respective earpiece to the inside of the vertex of the respective center extent. The hollow interior helps enhance acoustic resonance for the speakers and the center post provides structural support to the center extent.

An optional volume control 40 of the invention, shown in FIG. 5 of the drawings, may be mounted on the outer face of one of the earpieces, and controls the volume of sound produced by each of the speakers mounted on the earpieces.

One embodiment of the invention also includes transmitting means for transmitting sound signals from a sound signal source to the speakers of the earpieces. The transmitting means may comprise hard-wired connecting structures, or may comprise means for wirelessly transmitting signals to the headphones.

In one highly preferred embodiment of the invention, the transmitting means comprises a signal cord assembly (see FIGS. 6 through 8) for transferring sound signals to the speakers. The signal cord assembly may include a headphone cord 44 with a plurality of electrical conductors that are each electrically connected to one of the speakers mounted on the earpieces for providing sound signals to the speakers.

The signal cord assembly preferably also includes a signal jack 46 electrically connected to the electrical conductors of the headphone cord, and a signal plug 48 electrically connected to a linking cord 50, with the signal plug and signal jack being detachably connectable together. The signal jack 46 has a free end 52 with an outer surface located adjacent to the free end. A recess 54 is formed in the free end of the signal jack and is defined by an inner surface 55.

The signal jack 46 includes a positive contact assembly, which is comprised of a plurality of conductive contacts 56 forming a substantially cylindrical outer surface on the signal jack. Each of the conductive contacts 56 is in electrical communication with one of electrical conductors of the cord. Illustratively, the plurality of conductive contacts may comprise eight conductive contacts. The plurality of conductive contacts may be arranged in a pair of circumferentially-extending rows 58, 59. Each of the rows may have four conductive contacts therein, such that eight conductive contacts are located in the two rows. A negative contact 60 may be positioned on a substantially cylindrical inner surface 54 of the recess. Optionally, the signal jack may include a guide protrusion 62 may extend outwardly from the outer surface of the signal jack 46. The guide protrusion may extend from the free end 52 of the signal jack. The guide protrusion may extend between at least two of the conductive contacts.

The signal plug 48 is provided for releasably mating with the signal jack 46 for transferring sound signals therebetween. The signal plug has a free end 64 for complementarily mating with the free end 52 of the signal jack 46. The signal plug may have an annular groove 66 that extends into the free end 64 of the signal plug for receiving a portion of the signal jack. The annular groove is defined by a central prong 68 and an annular surface 69 that is radially spaced from the central prong.

The signal plug may include a negative contact 70 positioned on the central prong 68 of the signal plug. A positive contact assembly of the signal plug may comprise a plurality of conductive contacts 72 forming a substantially cylindrical annular surface 69. The plurality of conductive contacts 72 of the signal plug is preferably equal in number to the number of conductive contacts 56 of the signal jack. The plurality of conductive contacts may comprise eight conductive contacts when eight speakers, or eight pairs of speakers, are mounted on the earpieces. The plurality of conductive contacts 72 is arranged in a pair of circumferentially-extending rows 73. Each of the rows 73 may have four conductive contacts 72 therein.

The linking cord 50 may comprise a plurality of electrical conductors (not shown). Each of the electrical conductors is in electrical communication with one of the conductive contacts 72 and the negative contact 70 on the signal plug.

Optionally, the invention may include a controller unit 74 (see FIGS. 9 and 10) for providing sound signals to the headphone assembly. The controller unit is in communication with the headphone assembly. The communication with the headphones may be through wireless means, but preferably the controller unit is electrically connected to the linking cord 50 described above. The controller unit may optionally include a microphone jack 51 for connecting to an external microphone, such as the microphone 88.

The controller unit 74 may comprise an equalizer 76 for permitting adjustment of characteristics of sound signals being passed from the controller unit to the linking cord. The equalizer may include a plurality of slide adjustment switches for varying frequency characteristics of sound signals being passed to the linking cord. The controller unit 74 may further include a sound signal processor 78 for dividing sound signals inputted into the controller unit into component sound signals outputted on the plurality of electrical conductors of the linking cord. The sound signal processor may divide sound signals into eight component sound signals. A wireless transmitter 77 may also be included in the controller unit for transmitting (and optionally receiving) control signals.

Figure 13:
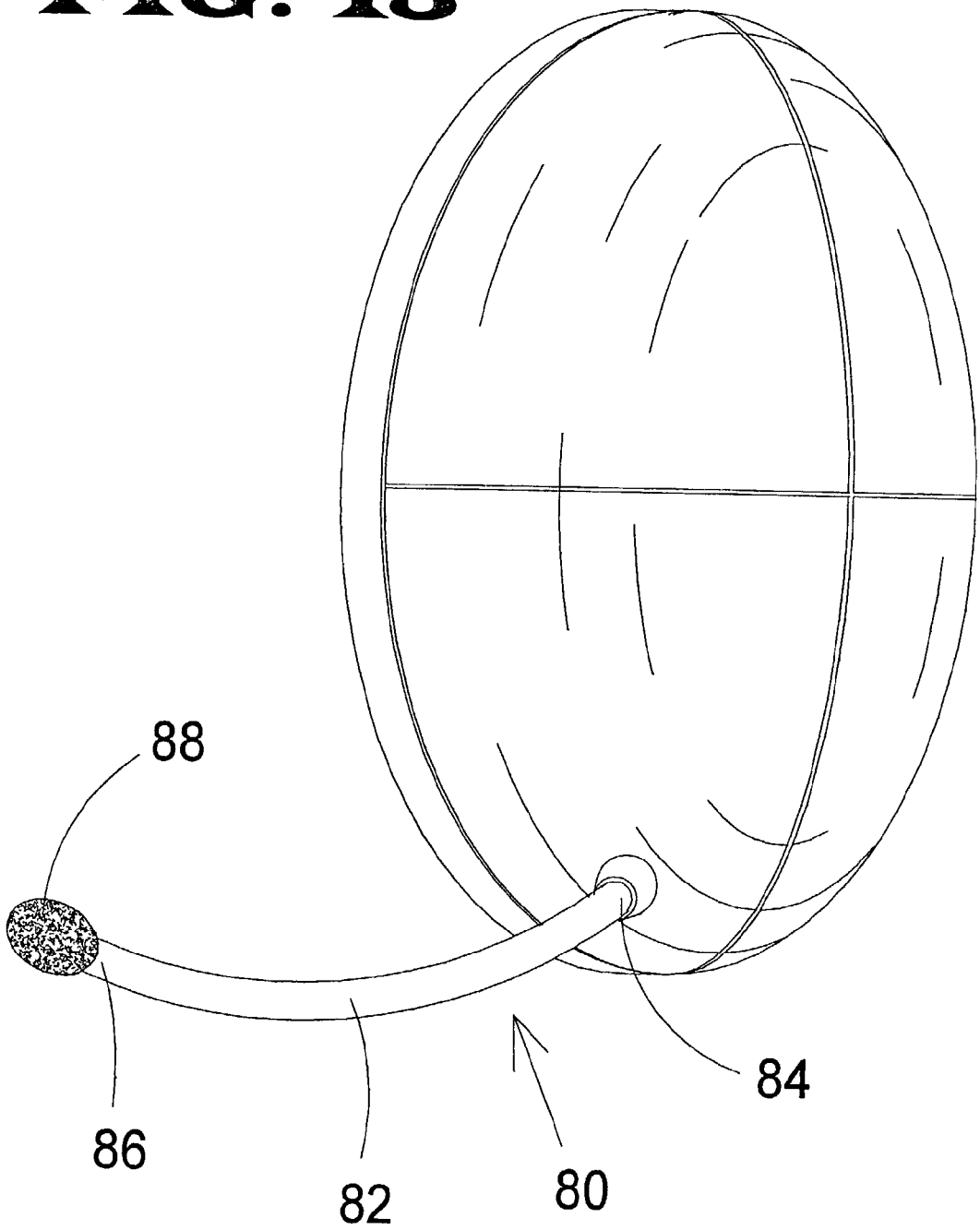
FIG. 13 is a schematic side view of an earpiece having the optional microphone assembly of the present invention.

Optionally, the invention may include a microphone assembly 80 that is mounted on one of the earpieces (see FIG. 13). The microphone assembly 80 may comprise a stalk 82 having a first end 84 mounted on the outer shell of one of the earpieces and a second end 86 being substantially free and extending away from the earpiece. Preferably, the stalk 82 is flexible such that the stalk is adapted to hold a bend when the stalk is bent by the user. A microphone 88 may be mounted on the second end of the microphone stalk. When the microphone assembly 80 is employed, a microphone plug 89 may be included on the headphone cord 44 (see FIG. 6) and a microphone jack 91 may be included on the linking cord 50 (see FIG. 7)

Figure 11:
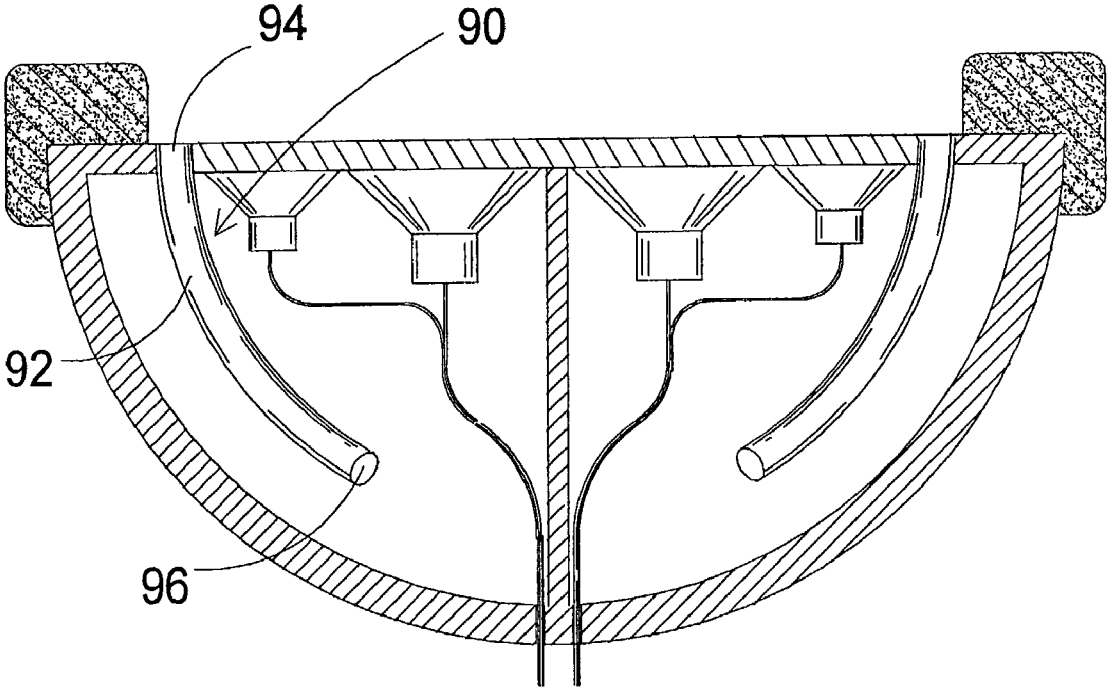
FIG. 11 is a schematic sectional view of an earpiece having the optional port feature of the present invention.
Figure 12:
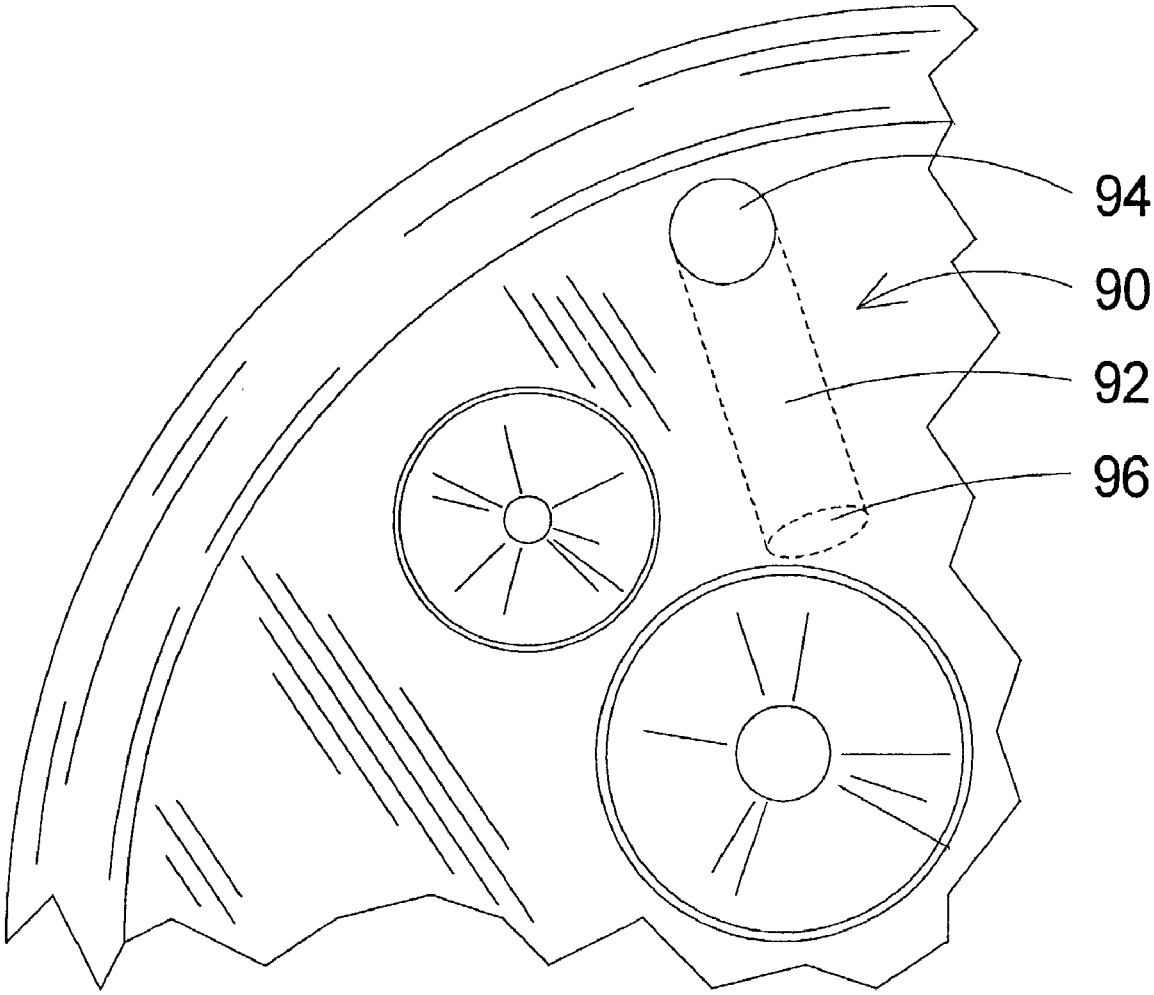
FIG. 12 is a schematic top view of a broken away quadrant portion of an earpiece having the optional port features of the present invention.

As a further option, a port 90 may be provided in each of the compartments for enhancing the reproduction of lower frequencies by the earpieces (see FIGS. 11 and 12). Each port 90 may comprise a tube 92 having a first end 94 that is mounted on the front wall of the earpiece and a second end 96 that is positioned in the interior of one of the compartments. Each tube has a lumen that is in fluid communication with an interior of the compartment and an exterior of the earpiece. The length of the tubes may be adjusted, or tuned, to a length that enhances the desired lower frequencies of the sound reproduced.

Figure 14:
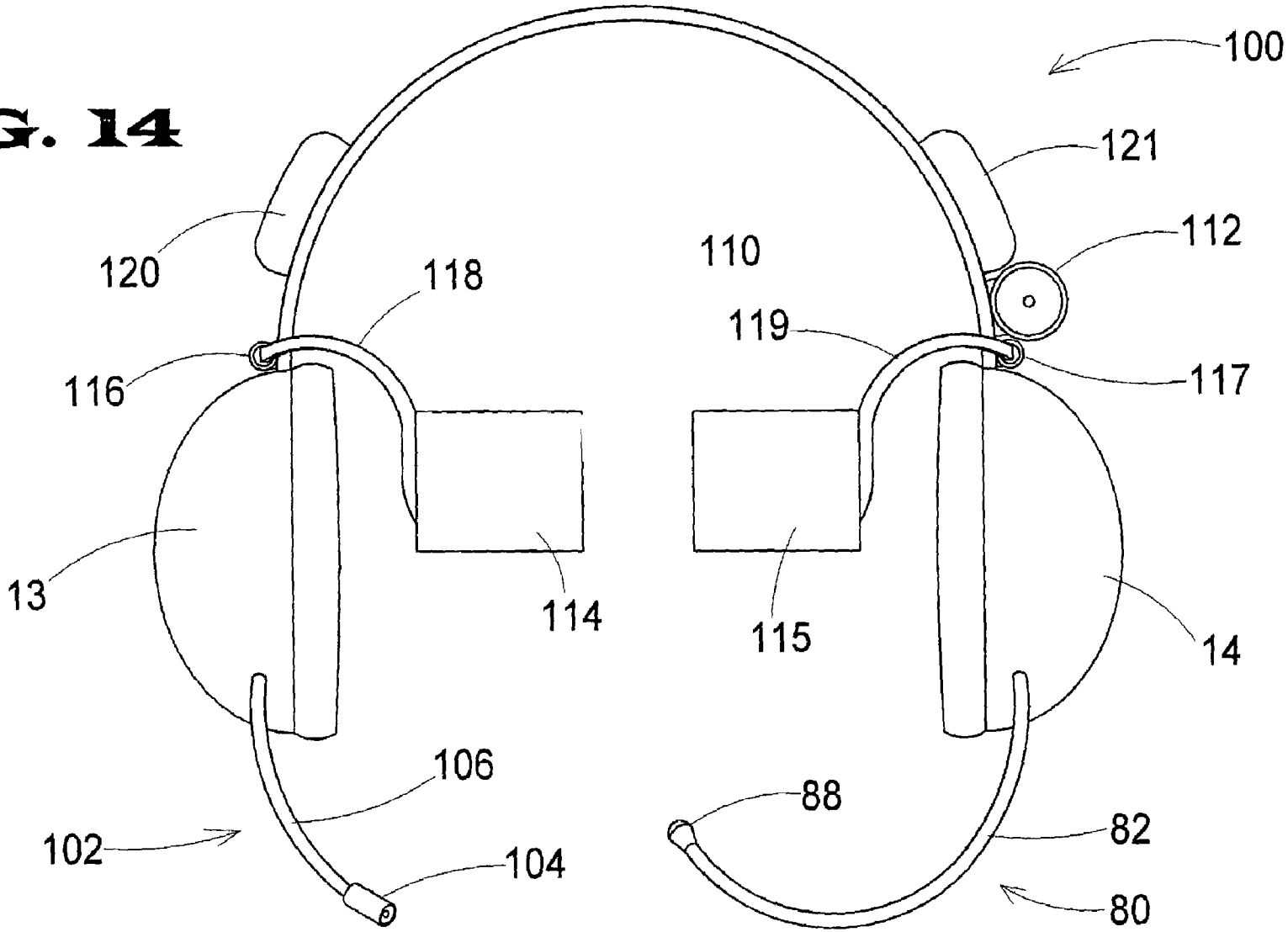
FIG. 14 is a schematic front view of an embodiment having optional features such as a microphone assembly, light projection assembly, image display system, camera, and battery.
Figure 15:
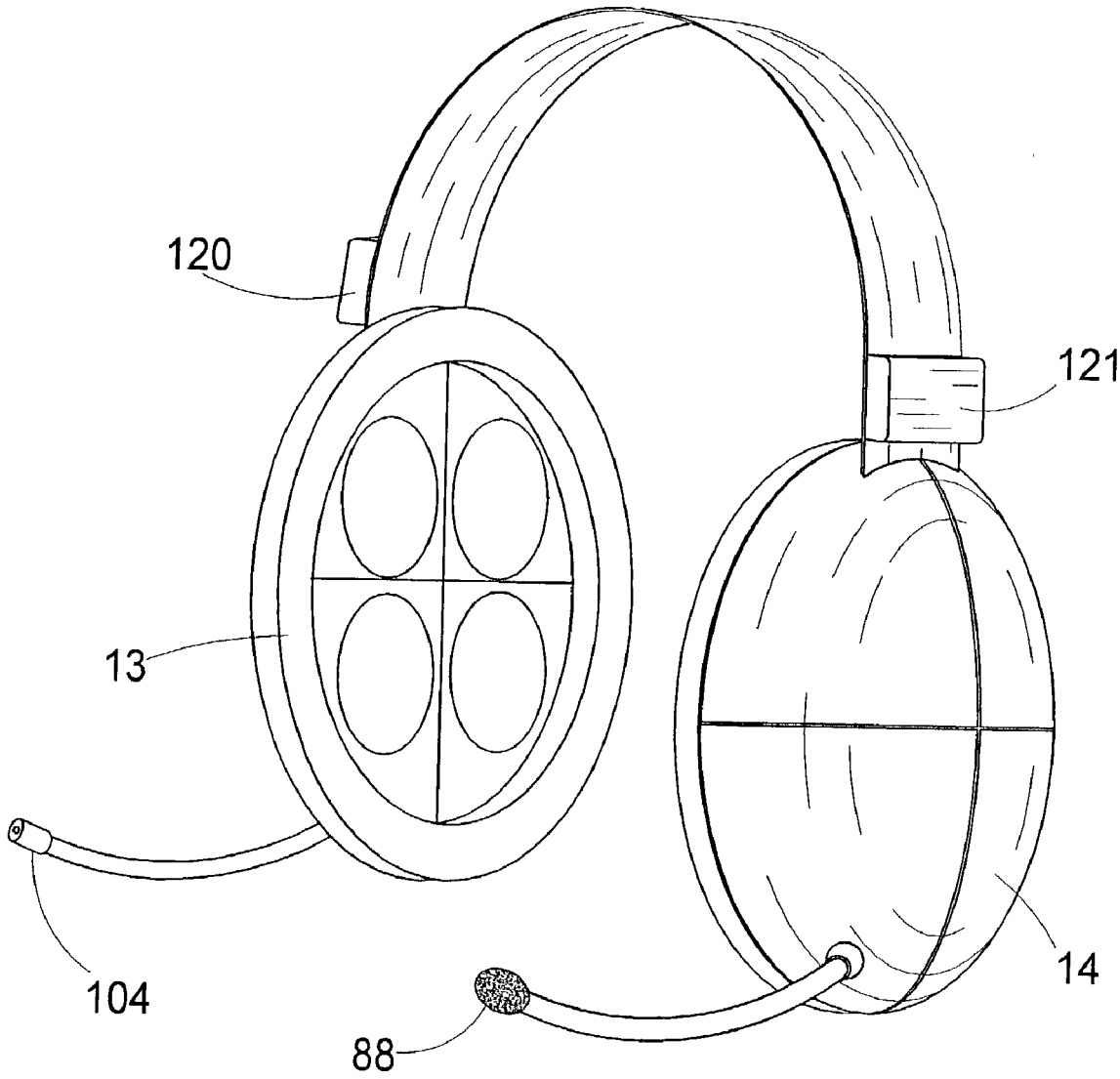
FIG. 15 is a schematic side view of the embodiment of FIG. 14.
Figure 16:
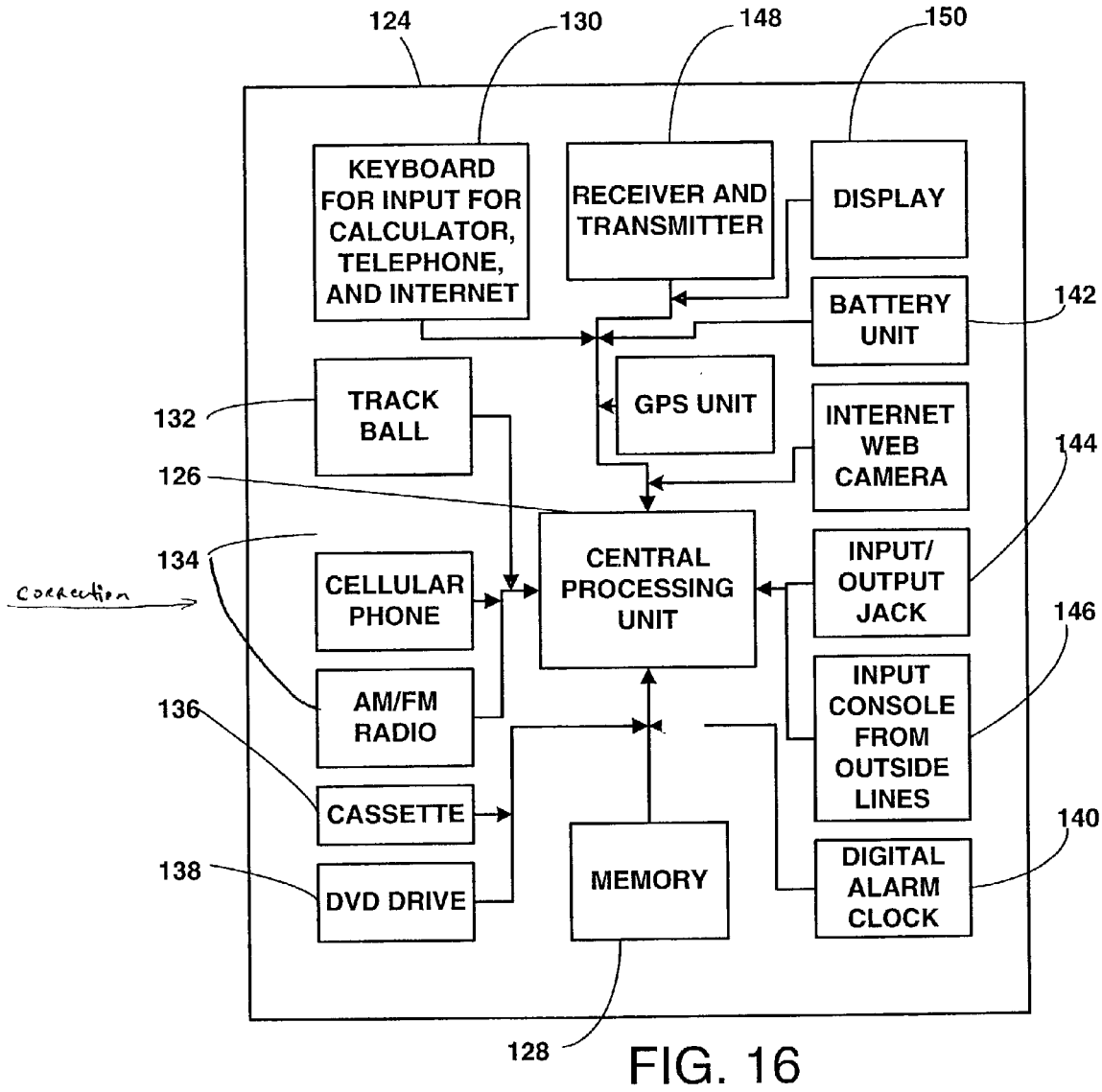
FIG. 16 is a schematic diagram of an embodiment of the invention.

An embodiment of the invention having a number of optional features is illustrated in FIGS. 14 and 15 of the drawings. A set of headphones 100 may include a microphone assembly 80 mounted on one of the earpieces. A light projection assembly 102 may be mounted on one of the earpieces, such as the opposite earpiece from the earpiece having the microphone assembly 80 mounted thereon. The light projection assembly may include a light 104 mounted on a free end of a flexible stalk 106 mounted on the earpiece, which permits adjustment of the direction of the light beam emitted from the light to shine.

One significant optional feature of the invention is an image display system 110 that is mounted on the headphones and is carried by the headphones. The image display system 110 may include a digital camera 112 for capturing images for the image display system, and in one embodiment of the invention the digital camera may be mounted on the headband and may be located adjacent to and above one of the earpieces. The digital camera 112 is pointed forward in a direction substantially parallel to the sight line of a person wearing the invention. The image display system 110 may also include one or more image display screens 114, 115 that may be pivotally mounted on the headphones by pivot mounts 116, 117 for pivoting between an in-use position in front of the face of the user when the headphones are worn, and a non-use position in which the image display screens are pivoted upwardly from the in-use position for moving the image display screens out of the sight line of the user. Each of the image display screens may be mounted on an arm 118, 119 that extends between the headband and the respective screen. Each screen 114, 115 may comprise a substantially planar member that includes a display surface that may be formed of a plurality of display elements such as, for example, liquid crystal pixels. The pivotal adjustability of the image display system permits the user not only to move the screens out of the way when not in use, but also to achieve optimal positioning of the screens with respect to the user's sight when the image display system is in use. The screens 114, 115 may be adapted to display images such as computer generated images, video images such as television and prerecorded content, and graphic images generated by calculators. It should be understood that some embodiments of the invention may use only one of the screens, and in embodiments of the invention employing a pair of the screens, the user may be permitted to selectively use only one of the screens at a time is desired.

The headphones of the invention may optionally include an integrated power source, which may comprise one or optionally a pair of battery housings 120, 121 mounted on the headband of the invention in a position above the headband. The battery housings may be adapted to permit the replacement of disposable batteries, or may be adapted to house more permanent rechargeable batteries.

Optionally, the systems of the invention may be controlled from a control console, such as is integrated into a portable case 124 (see FIG. 16) that houses control circuitry for the system, including a central processing unit 126 with memory 128 and input device or devices such as a keyboard 130 and/or track ball 132. The control console may also include a number of optional components, such as audio listening components (e.g., a radio tuner 134, a cassette player 136), a digital versatile disc (DVD) drive 138, and a digital alarm clock 140. The control console may also include a battery 142 for powering the various circuits. There also may be various means of communication for the central processing unit, including an input/output jack 144, various inputs from outside lines 146, and a receiver/transmitter 148. Other optional components may include a power antenna, a citizens band radio, a two-way radio, a universal serial bus (USB) port, Internet web camera, global positioning system (GPS) unit, and cellular telephone. Optionally, the control console may also include its own display screen 150.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A headphone system comprising:

a headphone assembly for wearing on the head of a user, comprising:

a pair of earpieces, each earpiece being adapted for positioning adjacent to an ear of the user, each of said earpieces having an open inner face, each of said inner faces of said earpieces defining a cavity in said earpiece, each of said inner faces of said earpieces having a center extent in said cavity of the respective earpiece, said center extent of each earpiece having a vertex and at least two side faces, each of said side faces having at least one speaker mounted thereon;

connecting means for connecting said earpieces such that the earpieces are positionable adjacent to the ears of the user; and transmitting means for transmitting sound signals from a s sound signal source to the speakers of said earpieces, said transmitting means transmitting a separate sound signal to each of said speakers in each of said earpieces;

wherein said transmitting means comprises a signal cord assembly for transferring a separate sound signal to each of said speakers of each of said earpieces, said signal cord assembly including:

a headphone cord with a plurality of electrical conductors, each of said plurality of conductors being electrically connected to one of said speakers mounted on said earpieces for providing sound signals to said speakers;

a signal jack electrically connected to the electrical conductors of said cord, said signal jack having a free end with an outer surface located adjacent to said free end, a recess being formed in the free end of said signal jack and being defined by an inner surface, said signal jack comprising:

a positive contact assembly comprising a plurality of conductive contacts with each of said conductive contacts being in electrical communication with one of said electrical conductors of said cord; and a negative contact positioned in said recess;

a signal plug for releasably mating with said signal jack for transferring sound signals therebetween, said signal plug having a free end for complementarily mating with the free end of said signal jack, said signal plug having an annular groove extending into the free end of said signal plug for receiving a portion of said signal jack, said annular groove being defined by a central prong and an annular surface radially spaced from said central prong, said signal plug comprising:

a negative contact positioned on said central prong of said signal plug;

a positive contact assembly comprising a plurality of conductive contacts being present in an equal number to the conductive contacts of said signal jack, said plurality of conductive contacts comprising eight conductive contacts.

2. The system of claim 1 wherein said signal cord assembly additionally comprises a linking cord comprising a plurality of electrical conductors, each of said electrical conductors being in electrical communication with one of said conductive contacts and said negative contacts on said signal plug.

3. The system of claim 1 wherein said plurality of conductive contacts of said signal jack form a substantially cylindrical said outer surface on said signal jack, and wherein said plurality of conductive contacts of said signal plug form a substantially cylindrical annular surface such that said conductive contacts of said signal jack abut said conductive contacts of said signal plug when said signal plug and said signal jack are mated together.

4. The system of claim 3 wherein said plurality of conductive contacts of said signal jack and said signal plug are arranged in at least one circumferentially-extending row.

5. The system of claim 4 wherein each of said signal jack and said signal plug has a pair of said rows.

6. The system of claim 5 wherein each of said rows has four conductive contacts therein.

7. The system of claim 1 wherein said signal jack additionally comprises a guide protrusion extending outwardly from an outer surface of said signal jack, said guide protrusion extending from the free end of said signal jack, and wherein said signal plug additionally comprises a guide groove being formed on said signal plug and being in communication with said annular groove of said signal plug, said guide groove extending from said free end of said signal plug and being adapted to receive said guide protrusion when said signal plug and said signal jack are mated.

8. The system of claim 7 wherein said guide protrusion extends between at least two conductive contacts of said signal jack and said guide groove extends between at least two conductive contacts of said signal plug.

9. The system of claim 1 wherein said plurality of conductive contacts of said signal jack comprises eight conductive contacts and said plurality of conductive contacts of said signal plug comprises eight conductive contacts.

10. A headphone system comprising:

a headphone assembly for wearing on the head of a user, comprising:

a pair of earpieces, each earpiece being adapted for positioning adjacent to an ear of the user, each of said earpieces having an open inner face, each of said inner faces of said earpieces defining a cavity in said earpiece, each of said inner faces of said earpieces having a center extent in said cavity of the respective earpiece, said center extent of each earpiece having a vertex and at least two side faces, each of said side faces having at least one speaker mounted thereon;

connecting means for connecting said earpieces such that the earpieces are positionable adjacent to the ears of the user; and transmitting means for transmitting sound signals from a sound signal source to the speakers of said earpieces, said transmitting means transmitting a separate sound signal to each of said speakers in each of said earpieces; and an image display system including a pair of display screens, each of said display screens being pivotally mounted on the connecting means adjacent to a respective one of said earpieces for pivot movement independent of each other, each of said display screens having display elements thereon for displaying images.

11. The system of claim 10 wherein each of said image display screens is pivotally mounted with respect to a respective said earpiece such that each of said image display screens pivots about an axis that is substantially perpendicular to a plane defined by said connecting means connecting said earpieces.

12. The system of claim 11 wherein each of said display screens has an in-use position in which said display screen extends inwardly from a respective one of said earpieces and a non-use position in which said display screen is pivoted out of said in-use position toward said respective earpiece.

13. A headphone system comprising:

a headphone assembly for wearing on the head of a user, comprising:

a pair of earpieces, each earpiece being adapted for positioning adjacent to an ear of the user, each earpiece having an outer shell with an inner face and a peripheral edge defining an opening, each earpiece having a front wall extending across the opening, a set of divider walls extending from the front wall to the inner face of the outer shell to define a plurality of compartments, a pair of speakers for each of the compartments, each pair of speakers being mounted on the front wall and extending into one of the compartments, a first one of the pair of speakers having a diameter greater than a second one of the pair of speakers;

connecting means for connecting the earpieces such that the earpieces are positionable adjacent to the ears of the user; and a port for each of the compartments, each port comprising a tube having a first end mounted on the front wall and a second end positioned in one of the compartments, each tube having a lumen in fluid communication with an interior of one of the compartments and an exterior of the earpieces.

14. A headphone system comprising:

a headphone assembly for wearing on the head of a user, comprising:

a pair of earpieces, each earpiece being adapted for positioning adjacent to an ear of the user, each of said earpieces having an open inner face, each of said inner faces of said earpieces defining a cavity in said earpiece;

wherein each of said inner faces of said earpieces has a center extent in said cavity of the respective earpiece, said center extent of each earpiece having a vertex and a plurality of side faces; and wherein each of said side faces of said center extent of each earpiece has at least one speaker mounted thereto;

connecting means for connecting said earpieces such that the earpieces are positionable adjacent to the ears of the user, said connecting means comprising an arcuate headband connecting the pair of earpieces together;

a volume control for controlling volume of sound of said speakers of said earpieces, said volume control being mounted on an outer face of said one of said earpieces;

transmitting means for transmitting sound signals from a sound signal source to the speakers of said earpieces, said transmitting means comprising a signal cord assembly for transferring sound signals to said speakers, said signal cord assembly including:

a headphone cord with a plurality of electrical conductors electrically connected to said speakers mounted on said earpieces for providing signals to said speakers;

signal jack electrically connected to the electrical conductors of said cord, said signal jack having a free end with an outer surface located adjacent to said free end, a recess being formed in the free end of said signal jack and being defined by an inner surface, said signal jack comprising:

a positive contact assembly comprising a plurality of conductive contacts forming a substantially cylindrical said outer surface on said signal jack, each of said conductive contacts being in electrical communication with one of electrical conductors of said cord, said plurality of conductive contacts comprising eight conductive contacts;

wherein said plurality of conductive contacts are arranged in a pair of circumferentially-extending rows, each of said rows having four conductive contacts therein;

a negative contact positioned on a substantially cylindrical said inner surface of said recess;

a guide protrusion extending outwardly from the outer surface of said signal jack, said guide protrusion extending from the free end of said signal jack, said guide protrusion extending between at least two of said conductive contacts;

a signal plug for releasably mating with said signal jack for ttransferring sound signals therebetween, said signal plug having a free end for complementarily mating with the free end of said signal jack, said signal plug having an annular groove extending into the free end of said signal plug for receiving a portion of said signal jack, said annular groove being defined by a central prong and an annular surface radially spaced from said central prong, said signal plug comprising;

a negative contact positioned on said central prong of said signal plug;

a positive contact assembly comprising a plurality of conductive contacts forming a substantially cylindrical said annular surface, said plurality of conductive contacts of said signal plug being equal to a number of conductive contacts of said signal jack, said plurality of conductive contacts comprising eight conductive contacts;

wherein said plurality of conductive contacts are arranged in a pair of circumferentially extending rows, each of said rows having four conductive contacts therein;

wherein said signal plug additionally comprises a guide groove being formed on said signal plug and being in communication with said annular groove of said signal plug, said guide groove extending from said free end of said signal plug and being adapted to receive said guide protrusion when said signal plug and said signal jack are mated;

a linking cord comprising a plurality of electrical conductors, each of said electrical conductors being in electrical communication with one of said conductive contacts and said negative contacts on said signal plug, a controller unit for providing sound signals to said headphone assembly, said controller unit being in communication with said headphone assembly, said controller unit being electrically connected to said linking cord, said controller unit comprising:

an equalizer for permitting adjustment of characteristics of sound signals being passed from said controller unit to said linking cord, said equalizer including a plurality of slide adjustment switches for varying frequency characteristics of sound signals being passed to said linking cord;

a sound signal processor for dividing sound signals inputted into said controller unit into component sound signals outputted on said plurality of electrical conductors of said linking cord, wherein said sound signal processor divides sound signals into eight component sound signals.

* * * * *